US007927228B2

(12) United States Patent
Rhodes

(10) Patent No.: US 7,927,228 B2
(45) Date of Patent: Apr. 19, 2011

(54) GOLF SWING TRAINING MAT

(76) Inventor: Stephen Rhodes, Roswell, NM (US)

( * ) Notice: Subject to any disclaimer, the term of this patent is extended or adjusted under 35 U.S.C. 154(b) by 0 days.

(21) Appl. No.: 12/585,426

(22) Filed: Sep. 15, 2009

(65) Prior Publication Data

US 2010/0069168 A1 Mar. 18, 2010

Related U.S. Application Data

(60) Provisional application No. 61/098,162, filed on Sep. 18, 2008.

(51) Int. Cl.
*A63B 69/36* (2006.01)

(52) U.S. Cl. ..... 473/270; 473/278

(58) Field of Classification Search ..... 473/218, 473/257, 266, 270, 272, 278
See application file for complete search history.

(56) References Cited

U.S. PATENT DOCUMENTS

| | | | | |
|---|---|---|---|---|
| 2,457,351 | A * | 12/1948 | Crowley | 473/272 |
| 3,561,764 | A * | 2/1971 | Thomas | 473/257 |
| D239,726 | S | 4/1976 | Wintering | |
| D272,379 | S | 1/1984 | Cachola | |
| 4,583,739 | A | 4/1986 | Kabbany | |
| 5,042,815 | A | 8/1991 | Sutton | |
| 5,108,106 | A * | 4/1992 | Cook | 473/272 |
| 5,398,937 | A | 3/1995 | Reagan | |
| 5,944,613 | A | 8/1999 | Dubois | |
| 7,131,910 | B2 * | 11/2006 | Townsend, II | 473/278 |
| D559,344 | S | 1/2008 | Walsh et al. | |
| 7,527,562 | B1 * | 5/2009 | Mason | 473/257 |
| 2009/0176595 | A1 | 7/2009 | Hubley | |

FOREIGN PATENT DOCUMENTS

| | | |
|---|---|---|
| CA | 2114928 | 5/1996 |

* cited by examiner

*Primary Examiner* — Nini Legesse
(74) *Attorney, Agent, or Firm* — Welsh Flaxman & Gitler LLC

(57) ABSTRACT

A golf swing training aid to allow a golfer to learn the correct swing path utilizes a mat having three visual guidelines displayed thereon or therethrough. One guideline is aimed at the target. A second guideline would guide the club head on the back swing and a third guideline would show a greater inside angle to the target line that the club should make on its approach to the ball. A pair of bars are attached to the golf mat which would aid in correctly aligning the golfer's body to provide the proper stance when addressing a golf ball.

14 Claims, 4 Drawing Sheets

GOLF SWING TRAINING MAT

CROSS-REFERENCED APPLICATION(S)

The present invention claims the priority of U.S. provisional patent application Ser. No. 61/098,162, filed Sep. 18, 2008, and is incorporated herein.

FIELD OF THE INVENTION

The present invention is directed to a golf practice device.

BACKGROUND OF THE INVENTION

There is no question that for many years golf has been a very popular sport in both the U.S., as well as in Europe. The exploits of Tiger Woods have become legendary and there is no question that television ratings in the U.S. are at a very high level when Tiger Woods is in contention. Rather recently, golf has become more popular in other areas in the world such as South America due to Angel Cabrera winning the 2009 Masters as well as in South Korea, and other parts of Asia due to Y. E. Yang winning the 2009 PGA Championship.

While golf is very popular with more and more individuals learning the game, the game itself can be quite frustrating when it is not played properly. This is mainly due to a golfer who does not address the ball properly as well as not utilizing the proper swing plane to strike the ball in a manner allowing the ball to travel in a relatively straight path. Due to this fact, a multitude of products have been developed to assist a novice golfer as well as a more accomplished player to perfect their game. These products include the use of a specialized mat which would allow the player to learn to strike the ball properly. For example, U.S. Pat. No. 5,042,815, to Sutton; U.S. Pat. No. 3,561,764, to Thomas; D559,344 to Walsh; as well as Canadian Patent No. 2,114,928 to Hanson describe use of various mats for the purpose of assisting a golfer in perfecting their swing. While these references do describe the use of a mat provided with a recommended golf swing path, there is no inclusion of a path that the golfer can use during the down swing to gauge whether the golf club is in the proper swing plane. Additionally, these mats are not usually transportable and cannot be used for both right handed and left handed golfers. Finally, these mats are not provided with alignment bars allowing a player to correctly align their body to the golf shot in the most natural manner used by professionals in their pre-shot routine.

U.S. Patent Application Publication No. 2009/0176595, to Hubley; U.S. Pat. No. 5,944,613 to Dubois; U.S. Pat. No. 5,398,937 to Regan; U.S. Pat. No. 4,583,739, to Kabbany; U.S. Design Pat. No. D272,379 to Cachola; and U.S. Design Pat. No. D239,726, to Wintering all are directed to golf stance and ball alignment practice aids as well as golf swing training devices utilizing various alignment bars. However, none of these references can be used to perfect a golfer's swing as well as to properly align the golfer's body.

SUMMARY OF THE INVENTION

The deficiencies of the prior art are addressed by the present invention which utilizes a uniquely shaped mat provided with three indicia lines associated therewith. One of the lines is used as a target guideline and is pointed in the direction of flight of the golf ball. A second indicia line is provided at an angle over which the head of the golf club should travel during the back swing. The third indicia line is used for additionally illustrating the down swing position of the golf club called "the slot". This position occurs in the down swing at the point that the club shaft is parallel to the ground.

The exterior shape of the mat is designed such that the perimeter runs parallel at specific locations to the adjacent guideline associated with the mat and therefore would reinforce the visual effectiveness of the mat itself.

A target line bar and a ball alignment bar are used to allow the player to correctly align their body to the shot in the most natural manner used by professionals in their pre-shot routine. The target line bar is a guideline that the golfer simply faces directly and squares his or her body so as to complete the stance in a set-up routine as will be described. It is visually more effective and natural than trying to align the toes against a guideline as used in a number of prior art products. The ball alignment bar would run perpendicular to the target line bar when they are opened and deployed for use. The ball alignment bar points to the back of the ball, the impact point for shots hit directly off of the mat without a tee. It would show where the ball is positioned in relation to the feet.

The target line bar is directly connected to the underside of the rear portion of the mat. It is also directly connected to the ball alignment bar. A pivot stop lock arm extends between the end of the target line bar and the ball alignment bar and is used to position and lock these bars at a 90° angle to each other. The pivot stop lock arm contains a device for affixing the target line bar and the ball alignment bar at a 90° angle with respect to one another when the device is deployed. When this device is removed, the target line bar and the ball alignment bar as well as the mat can be folded together for carrying and removal of the mat, target line bar and the ball alignment bar.

The combination of the ball alignment bar, the target line bar, and the mat are designed to be used outdoors at a driving range or at any other exterior location, such as one's backyard. Additionally, the present invention is designed to be utilized indoors.

The purpose of the alignment bars and the mat are to endeavor to teach the player the proper swing plane as well as position of the club head during impact. Repeated use of this practice device followed by practice shots taken without the use of this device would instill in the golfer the proper muscle memory for properly striking the ball.

The product has a mirror image of itself so that it can be used by both left handed as well as right handed golfers. Additionally, the product could also be manufactured one sided and sold as a right or left handed model.

Additional advantages of the present invention will be set forth in part in the detailed description, which follows, and in part will be obvious from the description, or may be learned by practice of the invention. The advantages of the invention will be realized and obtained by means of the elements and combinations which will be pointed out in the detailed description. It is also to be understood that both the foregoing general description and the following detailed description are exemplary and explanatory aspects of the invention, and not restrictive to the invention.

DETAILED DESCRIPTION OF THE PREFERRED EMBODIMENT

The present invention 10 including the training mat 12, a target line bar 32, as well as a ball alignment bar 34 are shown in the deployed position upon a relatively planar surface such as will be provided at a golf range or other exterior locations, or indoors when the golf training mat and the alignment bars are situated on either a rug or a hard surface such as wood or concrete. When used outdoors, regular golf balls would be used during practice shots. When used indoors, foam or wiffle balls can be employed.

Figure 1:
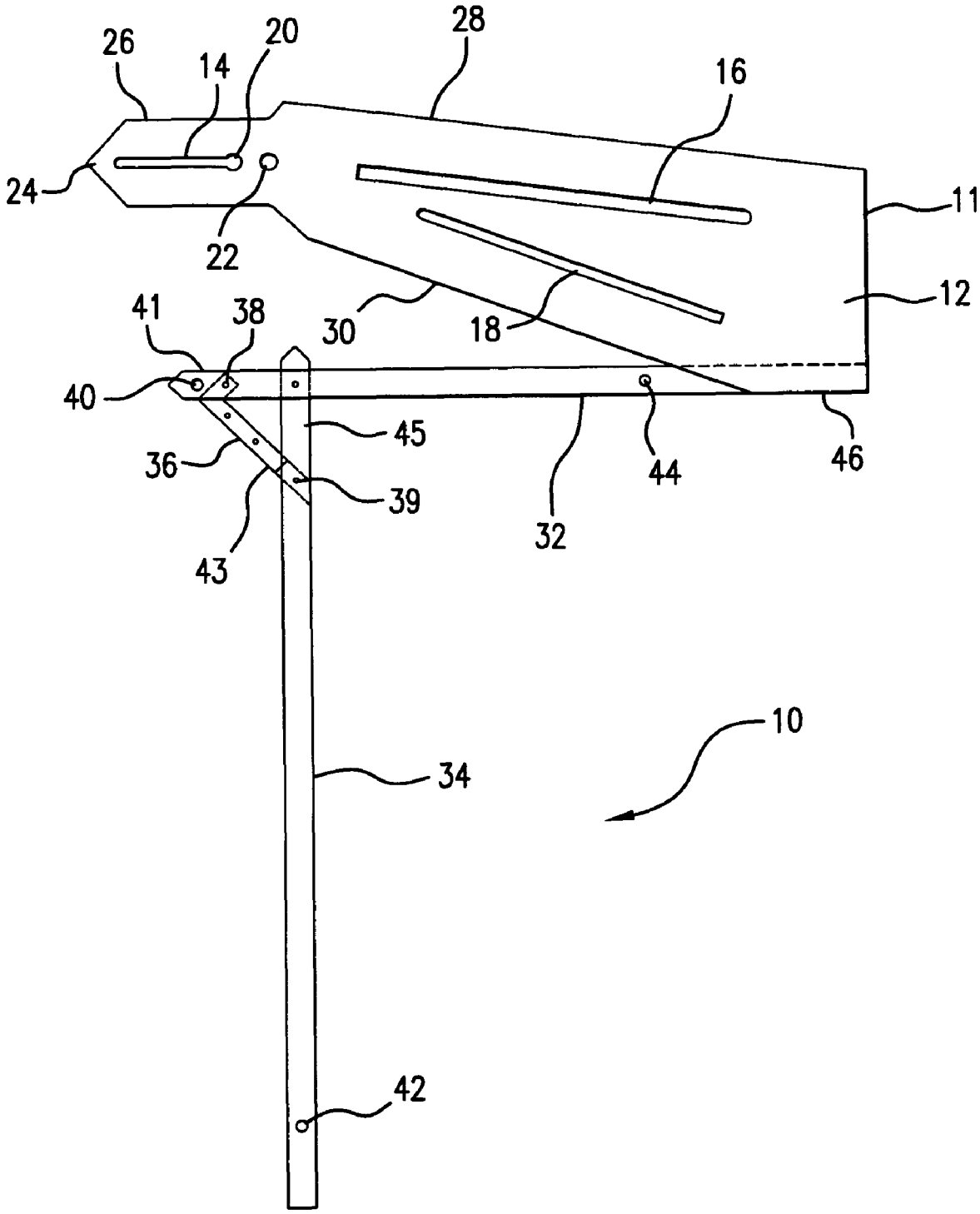
FIG. 1 is a top view of the golf swing training mat, the target line bar and the ball alignment bar when they are deployed for use.
Figure 2:
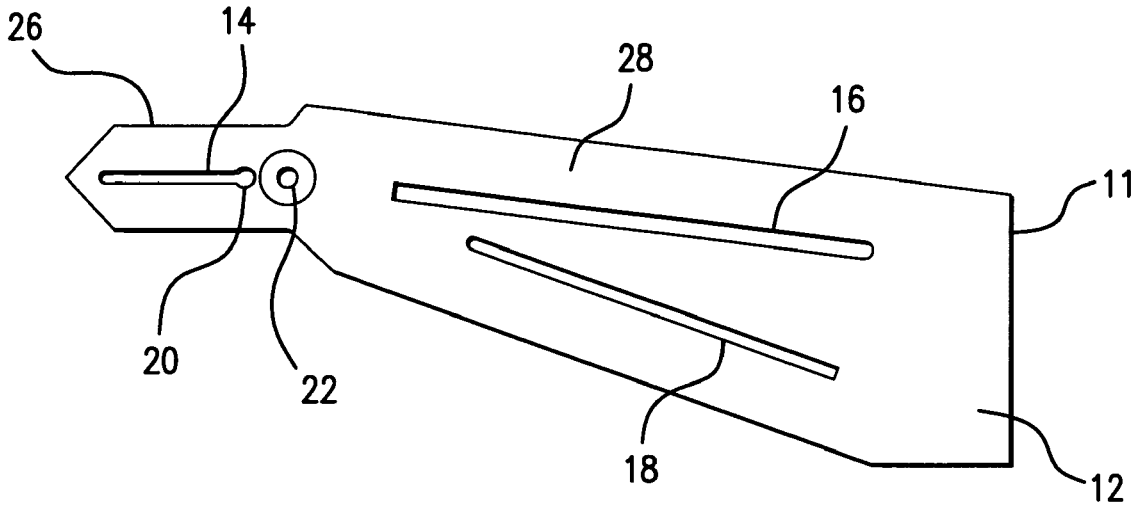
FIG. 2 is a top view of the mat.
Figure 3:
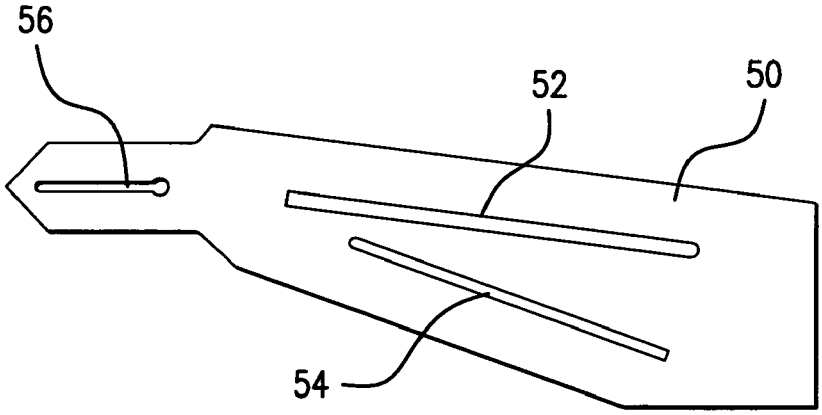
FIG. 3 is a top view of a sub-mat.

The golf mat 12 is cut in a specific pattern as shown in FIG. 2 with the sides of various portions of the perimeter of the mat cut at various angles with respect to horizontal. In one embodiment, the mat shown in FIGS. 1 and 2 would constitute a single piece of material. However, it is also contemplated that a sub-mat 50 as shown in FIG. 3 would be glued or attached in any other manner to the underside of the mat 12. The mat 12 is produced from any standard indoor/outdoor mat material, wherein the sub-mat 50 can be cut from a vinyl sheet material. The outside pattern of both the mat 12 as well as the sub-mat 50 would be exactly the same. When used with the sub-mat, the mat 12 would be provided with three slits or slots 14, 16 and 18. The top of the sub-mat 50 would be provided with a first colored line or tape 52 aligned with the slit 16 and extending for at least the length of the slit 16. A second colored line 54 would be provided under the slit 18 and would also extend for at least the length of the slit 18. A third colored line 56 would be associated with the slit 14 and would also extend for at least the entire length of the slit 14. For ease of use, each of the lines 52, 54 and 56 would be colored differently. For example, line 52 would be yellow, line 54 would be red and line 56 would be white. Obviously, other colors could be utilized. However, it would be of some importance that the lines 52, 54 and 56 be colored differently than each other. The mat 12 is provided with a hole 20 provided close to the slit 14 and would extend through the sub-mat 50. An indentation 22 would be provided on the top surface of the mat 12 slightly behind the hole 22. Indentation 22 would be used to place a ball directly onto the mat 12. Hole 20, which is generally smaller in diameter than the indentation 22, would be used to place a tee therein for allowing the golfer to practice a tee shot. The hole 20 is also large enough to accommodate a rubber tee used with golf practice mats when a player is using a driver.

The colored line 56 showing through the slit 14 is used as a target to which a golfer would aim. When used on a practice range, this target could be a flag stick, a distance marker or the like. When deployed, the pointed end of the mat 24 would also face the target. The guideline 56 is generally provided at 0° to the horizontal. A perimeter leg 26 adjacent to the slit 14 is also provided at 0° to the horizontal. A second perimeter leg below the slit 14 is also provided at 0° to the horizontal.

The colored line 52 is to be used during the golfer's back swing. This guideline is set at approximately 7.5° to the target, i.e. horizontal with respect to the pointed end of the mat 24. However, it is noted that this angle is not mandatory and could be provided in a range from approximately 5-10° from horizontal. The back swing guideline 52 points directly away from the standard ball position for balls hit directly off the mat from indentation 22. A perimeter leg 28 extending from approximately the position of indentation 22 to the end 11 of the mat 12 would be angled from the horizontal to the same degree as of the back swing guideline 52 and the slit 16.

The third guideline 54 is denoted as the down swing guideline and is set at approximately a 20° angle in relation to the horizontal or target guideline 56. This 20° angle is most effective for visually illustrating the down swing position denoted as "the slot". This guideline shows what the shaft angle should be as it starts to enter the impact zone, the point in which the shaft becomes parallel to the ground and the golfer's hands are approximately even with their right foot. As was true with respect to the back swing target guideline, the exact angle of the down swing guideline is not important and could be included in a range from 15-25°. This down swing guideline 54 shows the correct inside approach to the ball in the ideal golf swing. The angle is not exactly the same as the club head path into the ball, but rather would indicate the correct club shaft angle on the down swing at an easily discernable checkpoint, when the club shaft is parallel to the ground. A perimeter leg 30 adjacent to the guideline 54 and the slit 18 which extends from approximately adjacent to indentation 22 and close to the end 11 of the mat 12 would be of the same angle as the down swing guideline 54. The fact that the angles of the perimeter legs 26, 28 and 30 are the same as the angles of guidelines 52, 54 and 56, respectively would assist in both the novice as well as the advanced golfer to better visualize the correct golf swing.

The previously described mat having three alignment guidelines would be of limited use if the golfer's body was not properly aligned with the ball as well as the target to which the golfer is aiming. Therefore, the present invention includes alignment bars used for this purpose. A target line bar 32, when deployed, would run parallel to the target guideline 56. A ball alignment bar 34 would be perpendicular to the target line bar 32 when both bars are deployed. Both of the bars 32, 34 are constructed from any durable material, such as wood, metal or plastic. The target line bar 32 is hinged to the ball alignment bar 34 using a pivot stop lock arm 36. The pivot stop lock arm 36 is constructed from a modified corner bracket having a short side connected close to the end 41 of the target line bar 32 using a hinge 38. The longer side 43 of the pivot stop lock arm 36 is removably attached to the ball alignment bar 34 close to one end 45. This is accomplished by inserting a pin 39 into a corresponding hole in the pivot stop lock arm 36 and the ball alignment bar 34 when the target line bar 32 and the ball alignment bar 34 are perpendicular to one another as shown in FIG. 1. As shown in FIG. 1, the target line bar 32 is fixedly attached to the underside of the mat 12 at 46 if only a single piece of the mat is utilized or to the underside of the sub-mat 50 by gluing or any other manner of fixedly securing the ball alignment bar 32 to the mat. The ball alignment bar 34 is provided with at least one hole 42 and the target line bar 32 is provided with holes 40 and 44. The number and position of the holes on the bars 32, 34 and not of critical importance. The purpose of these holes is that when the mat and the alignment bars are deployed on a driving range or in a similar outdoor environment, they would be fixed in place by placing pins, tees or similar devices within the holes. When the mat is used indoors, a self-stick hook material would be attached to the appropriate places on the ball alignment bar 34 and the target line bar 32 so that the product can be secured on a carpeted floor for indoor use. If the mat is to be used on a hard surface, the target line bar 32 and the ball alignment bar 34 would be taped into place.

When not in use, the target line bar 32 and the ball alignment bar 34 as well as the pivot stop lock arm 36 would fold together for convenient carrying and storage along with the mat 12. Although the present invention has been primarily described using a top mat 12 and a sub-mat 50, the invention can be provided with the use of the sub-mat. In this case, the three guidelines 52, 54 and 56 would be directly applied to the top of the mat 12.

The process of deploying the bars 32, 34 and the mat 12 will now be explained. As previously indicated, the purpose of the present invention is to prevent the golfer from swinging the club on a poor swing plane as well as having the club face not properly aligned with the ball. The combination of bars 32, 34 and the mat 12 are removed from any carrying case and placed on the ground. When used outside, the pointed end 24 of the mat 12 which is aligned with the target guideline 14 should be directly facing a target, such as a golf pin or distance marker. This can be accomplished by using the golfer's eyes to properly aim the end 24 to the target or through the use of a plumb line. Once the proper line is established, the target line bar 32 must be made perpendicular with respect to the ball alignment bar 34 using the hinged pivot stop lock arm 36. Once this accomplished, a pin or tee 39 is placed in the corresponding hole of the pivot stop lock arm 36 and the ball alignment bar 34.

Figure 4:
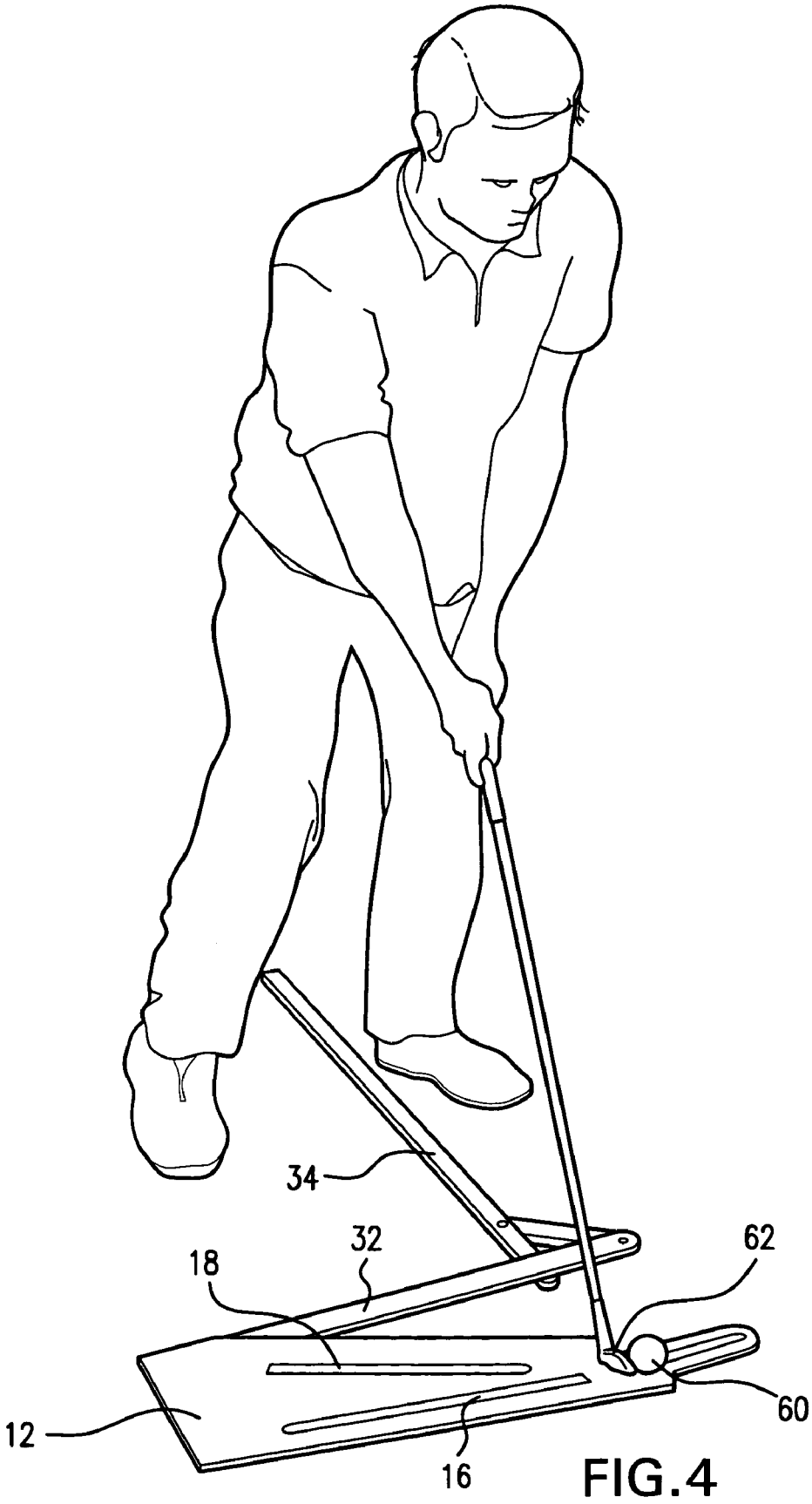
FIG. 4 is a perspective view of a golfer using the golf training mat.
Figure 5:
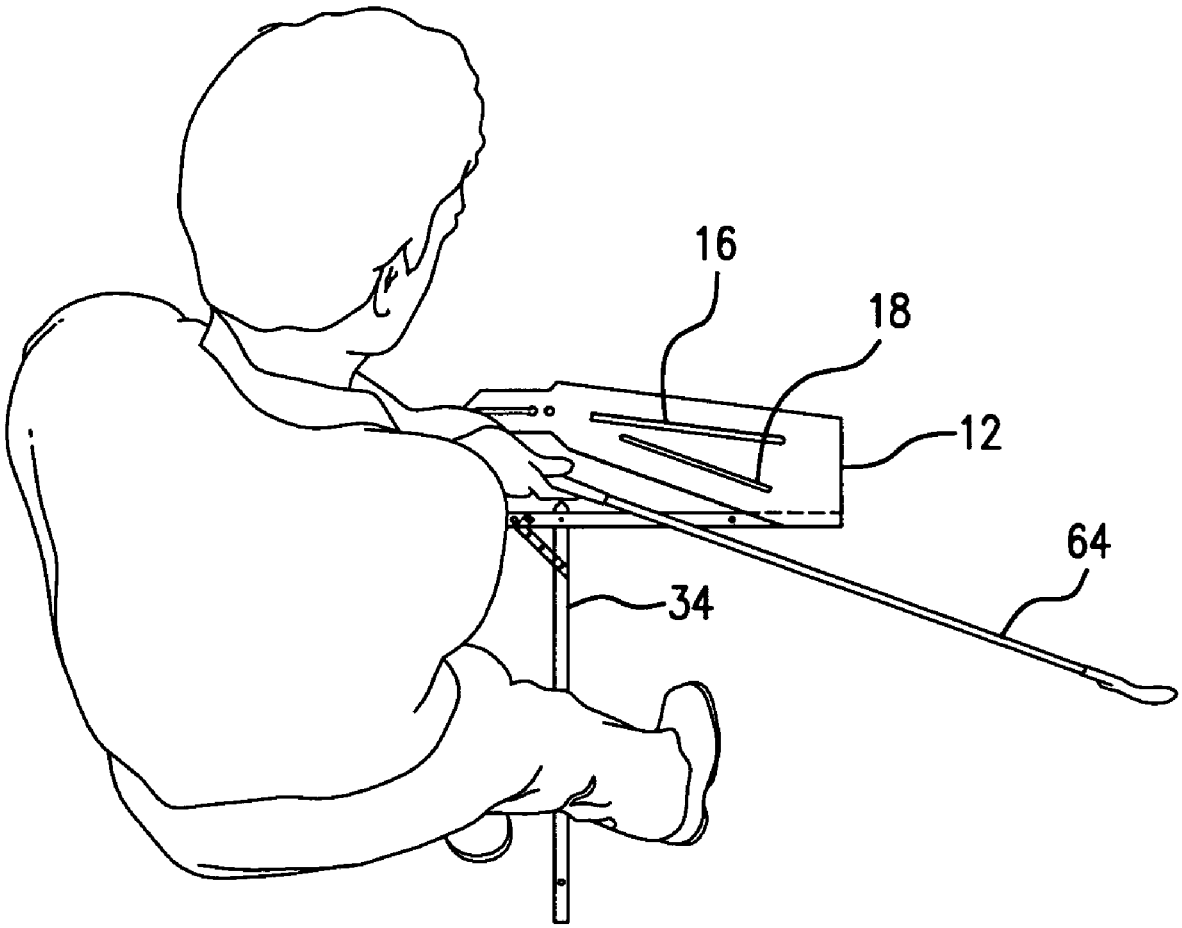
FIG. 5 is an overhead view showing the golfer utilizing the golf training device in the "slot" position.

At this point, when used by a right handed golfer, the golfer would stand behind the ball alignment bar 34 with his left toe almost directly behind the ball alignment bar 34. The golfer would then put his right foot and the left foot behind the target line bar 32. As shown in FIG. 4, the golfer would align himself to the ball with the ball alignment bar 34 closer to the left foot than the right, which would correctly position his body in relation to the ball. The target line bar 32 would allow the player to correctly align the body to the shot in the most natural manner used by expert golfer's in their pre-shot routine. This invention is not merely a foot alignment guide, but rather an entire body alignment guide. It is a guideline that the golfer simply faces directly and squares his body as he completes his stance in the setup routine. It is visually more effective and natural than trying to align his toes against the guideline, as utilized in prior art products. Since the ball alignment bar 34 points to the back of the ball, it does show where the ball is positioned in relation to the golfer's feet.

The present invention would allow the golfer to square his body to the target line bar 32, which automatically aligns the golfer's body to the actual target. At this point, the player would swing the club head 62 over the back swing guideline 16 to set the swing properly on the right path and correct swing plane. If the ball 60 does not fly toward the target, the player knows that it is not the fault of the alignment, but rather, it must be the improper club face angle at impact or incorrect swing path through the ball. Continual practice with the present invention would gradually eliminate either or both of these problems since it would allow the golfer to change both the club face angle as well as the swing path during practice to determine the proper swing.

When using a driver, the ball 60 is teed up through the hole 20 which is directly behind the target line 14. This would allow the golfer to play the ball further forward in his stance for drive without having to stand on the ball alignment bar 34.

As illustrated in FIG. 6, the shaft of the club 64 is in the "slot" position of the golfer's down swing. This figure illustrates the midpoint of a swing when the golfer's hands are lined up approximately in front of his right hip and the club shaft 64 is level to the ground. This view shows how the shaft of the club 64 at this point of the swing is parallel to the down swing guideline slit 18. During various drills when the golfer is instructed to stop the club at the midpoint of the down swing, the golfer can see whether the shaft 64 of the golf club is parallel to the guideline slit 18. Through practice, and various drills, the golfer would be able to refine his swing so that the club would move through this pre-impact point properly and will gradually start to work automatically into the golfer's swing. The present invention would then cause the player to swing the club head into the ball at exactly the right angle of approach, which is actually an unspecified line on the mat falling somewhere between the back swing guideline slit 16 and the down swing guideline slit 18. When the club shaft is correctly aligned at this "slot" position in the down swing during an actual swing, the player will notice that his body and arms are moving in a synchronized, athletic manner.

Alternating the use of the present invention during practice drills followed by practice shots taken at a driving range will ingrain the correct alignment and swing motion in the best manner to the player, which will then translate to the same correct alignment and swing motion during actual play on the golf course. Use of the present invention will result in the golfer more consistently hitting the golf ball on the center of the club face (the sweet spot) along a ball flight as well as straighter shots applied to the target.

It will be apparent to those skilled in the art that various modifications and variations can be made in the present invention without departing from the scope of the invention. Other aspects of the invention will be apparent to those skilled in the art from consideration of the specification and practice of the invention as disclosed herein. It is therefore intended that the specification examples be considered as exemplary only.

What is claimed is:

1. A golf swing alignment and swing path guide, comprising:

a planar mat provided with a teeing location for a golf ball, said mat further provided with a first horizontal guideline extending for a finite distance in front of said teeing location, a second guideline angled at a first angle greater than zero with respect to said horizontal first guideline, said second guideline used as a guide during a golfer's back swing, said mat further provided with a third guideline extending for a finite distance on said mat behind the teeing location, said third guideline angled at a second angle with respect to said horizontal first guideline greater than said first angle, said third guideline used to align a golf club shaft during the golfer's down swing.

2. The golf swing alignment and swing path guide in accordance with claim 1, wherein said planar mat is provided with at least first, second and third legs, each of said first, second and third legs forming a portion of the perimeter of said planar mat, said first leg in proximity with said first horizontal guideline, said second leg in proximity with said second guideline and angled at said first angle with respect to said first horizontal guideline and said third leg in proximity with said third guideline and angled at said second angle with respect to said horizontal first guideline.

3. The golf swing alignment and swing path guide in accordance with claim 2, further including a base provided with the same perimeter as said planar mat and secured to the bottom of said planar mat, said first, second and third guidelines being linear slits provided in said planar mat, said base provided with a first line aligned with said first guideline, a second line aligned with said second guideline and a third line aligned with said third guideline, wherein said first line is visible through said first guideline slit, said second line is visible through said second guideline slit and said third line is visible through said third guideline slit.

4. The golf swing alignment and swing path guide in accordance with claim 3, wherein each of said first, second and third lines are a different color than the other lines.

5. The golf swing alignment and swing path guide in accordance with claim 1, further including a target line bar having a first end attached to said planar mat, said target line bar extending parallel with said first guideline and ending at a second end, and a ball alignment bar attached to said second end of said target line bar, said ball alignment bar perpendicular to said first alignment bar, when said first and second alignment bars are fully deployed.

6. The golf swing alignment and swing path guide in accordance with claim 5, further including a corner piece hinged to one of said bars and removably connected to the other of said alignment bars to aid in the alignment of said bars.

7. The golf swing alignment and swing path guide in accordance with claim 5, wherein said target line bar and said ball alignment bar are provided with at least one hole used to secure the golf swing alignment and swing path to the ground.

8. The golf swing alignment and swing path guide in accordance with claim 1, wherein said first angle is in the range of 5 to 10 degrees and said second angle is in the range of 15 to 25 degrees.

9. The golf swing alignment and swing path guide in accordance with claim 1, wherein said first angle equals 7.5 degrees and said second angle equals 20 degrees.

10. A golf swing alignment and swing path guide, comprising:

a planar mat provided with a teeing location for a golf ball, said mat further provided with a first horizontal guideline extending for a finite distance in front of said teeing location, a second guideline angled at a first angle with respect to said horizontal first guideline, said second guideline used as a guide during a golfer's back swing, said mat further provided with a third guideline extending for a finite distance on said mat behind the teeing location, said third guideline angled at a second angle with respect to said horizontal first guideline greater than said first angle, said third guideline used to align a golf club shaft during the golfer's down swing, wherein said planar mat is provided with at least first, second and third legs, each of said first, second and third legs forming a portion of the perimeter of said planar mat, said first leg in proximity with said first horizontal guideline, said second leg in proximity with said second guideline and angled at said first angle with respect to said first horizontal guideline and said third leg in proximity with said third guideline and angled at said second angle with respect to said horizontal first guideline; and a base provided with the same perimeter as said planar mat and secured to the bottom of said planar mat, said first, second and third guidelines being linear slits provided in said planar mat, said base provided with a first line aligned with said first guideline, a second line aligned with said second guideline and a third line aligned with said third guideline, wherein said first line is visible through said first guideline slit, said second line is visible through said second guideline slit and said third line is visible through said third guideline slit.

11. The golf swing alignment and swing path guide in accordance with claim 10, wherein each of said first, second and third lines are a different color than the other lines.

12. A golf swing alignment and swing path guide, comprising:

a planar mat provided with a teeing location for a golf ball, said mat further provided with a first horizontal guideline extending for a finite distance in front of said teeing location, a second guideline angled at a first angle with respect to said horizontal first guideline, said second guideline used as a guide during a golfer's back swing, said mat further provided with a third guideline extending for a finite distance on said mat behind the teeing location, said third guideline angled at a second angle with respect to said horizontal first guideline greater than said first angle, said third guideline used to align a golf club shaft during the golfer's down swing; and a target line bar having a first end attached to said planar mat, said target line bar extending parallel with said first guideline and ending at a second end, and a ball alignment bar attached to said second end of said target line bar, said ball alignment bar perpendicular to said first alignment bar, when said first and second alignment bars are fully deployed.

13. The golf swing alignment and swing path guide in accordance with claim 12, further including a corner piece hinged to one of said bars and removably connected to the other of said alignment bars to aid in the alignment of said bars.

14. The golf swing alignment and swing path guide in accordance with claim 12, wherein said target line bar and said ball alignment bar are provided with at least one hole used to secure the golf swing alignment and swing path to the ground.

* * * * *